US007485206B2

(12) United States Patent
Kirvesmäki et al.

(10) Patent No.: US 7,485,206 B2
(45) Date of Patent: Feb. 3, 2009

(54) APPARATUS IN CONNECTION WITH A HEADBOX OF A PAPER MACHINE OR EQUIVALENT

(75) Inventors: Jarmo Kirvesmäki, Jyväskylä (FI); Ilkka Kemiläinen, Leppävesi (FI); Hannu Turpeinen, Jyväskylä (FI); Janne Lappi, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 421 days.

(21) Appl. No.: 10/570,690

(22) PCT Filed: Sep. 6, 2004

(86) PCT No.: PCT/FI2004/000517

§ 371 (c)(1),
(2), (4) Date: Mar. 6, 2006

(87) PCT Pub. No.: WO2005/024127

PCT Pub. Date: Mar. 17, 2005

(65) Prior Publication Data

US 2007/0056708 A1 Mar. 15, 2007

(30) Foreign Application Priority Data

Sep. 9, 2003 (FI) ..... 20031286

(51) Int. Cl.
*D21F 1/00* (2006.01)

(52) U.S. Cl. ..... 162/336; 162/343; 162/344

(58) Field of Classification Search ..... 162/336, 162/344, 343

See application file for complete search history.

(56) References Cited

U.S. PATENT DOCUMENTS 5,674,364 A 10/1997 Pitkäjärvi (Continued)

FOREIGN PATENT DOCUMENTS

EP 0 635 599 1/1995

(Continued)

OTHER PUBLICATIONS

International Search Report issued in PCT/FI2004/000517.

(Continued)

*Primary Examiner*—Mark Halpern
(74) *Attorney, Agent, or Firm*—Stiennon & Stiennon

(57) ABSTRACT

A headbox apparatus of a paper machine or equivalent has a body (11). Dilution water (arrow $L_2$) is conducted through at least two rows of ducts (12$a_1$, 12$a_2$ . . . ) into each body mixing chambers (13$a_1$, 13$a_2$ . . . ). Each mixing chamber (13$a_1$, 13$a_2$ . . . ) is limited by vertical walls ($T_1$), a bottom wall ($T_2$) and a covering wall ($T_3$), and a partition wall (16$a_1$, 16$a_2$ . . . ). The ducts (14$a_{1.1}$, 14$a_{1.2}$ . . . ) on the inlet side of the mixing chamber extend into the mixing chamber (13$a_1$, 13$a_2$ . . . ) at a distance ($h_1$) from the ducts (15$a_{1.1}$, 15$a_{1.2}$ . . . , 15$a_{2.2}$ . . . ) on the outlet side of the mixing chamber (13$a_1$, 13$a_2$ . . . ), whereby an annular gap ($D_1$) is left between the aligned duct (14$a_{1.1}$, 14$a_{1.2}$ . . . 14$a_{2.1}$, 14$a_{2.2}$ . . . ) on the inlet side and the duct (15$a_{1.1}$, 15$a_{1.2}$ . . . , 15$a_{2.1}$, 15$a_{2.2}$ . . . ) on the outlet side. Each mixing chamber (13$a_1$, 13$a_2$ . . . ) is filled by dilution water which is conducted through the annular gap ($D_1$) to join the stock ($m_1$).

8 Claims, 6 Drawing Sheets

U.S. PATENT DOCUMENTS

| | | | | |
|---|---|---|---|---|
| 6,475,344 | B1 * | 11/2002 | Aidun | 162/216 |
| 6,544,387 | B2 * | 4/2003 | Huovila et al. | 162/216 |
| 6,610,175 | B2 * | 8/2003 | Aidun | 162/336 |

FOREIGN PATENT DOCUMENTS

| | | | |
|---|---|---|---|
| EP | 0 635 599 | A1 | 1/1995 |
| FI | 942780 | | 12/1995 |
| FI | 101726 | | 8/1998 |
| FI | 101726 | B | 8/1998 |
| FI | 20031286 | | 9/2003 |
| WO | WO 98/23812 | * | 6/1998 |
| WO | WO 98/46823 | | 10/1998 |
| WO | WO 2005/024127 | | 3/2005 |
| WO | WO 2005/024127 | A1 | 3/2005 |

OTHER PUBLICATIONS

Written Opinion of the International Searching Authority in PCT/FI2004/000517.
Search Report issued in Finnish Application FI 20031286.
Search Report issued in Finnish Application No. 20031286.

* cited by examiner

APPARATUS IN CONNECTION WITH A HEADBOX OF A PAPER MACHINE OR EQUIVALENT

CROSS REFERENCE TO RELATED APPLICATIONS

This application is a U.S. national stage application of international app. No. PCT/FI2004/000517, the disclosure of which is incorporated by reference herein, and claims priority on Finnish Application No. 20031286, filed Sep. 9, 2003.

BACKGROUND OF THE INVENTION

The invention concerns an apparatus in connection with the headbox of a paper machine or equivalent.

It has proved to be a problem with old headboxes that the distribution tube banks are there attached to the headbox structures in such a way that it has proved difficult to add a dilution profiling system to them. In known headboxes, the diluting profiling is done in such as way that the diluting liquid is conducted into one row of pipes formed by superimposed pipes. The number of dilution valves will hereby be high in many cases and many other mechanisms are also needed. In known device solutions, expensive machining is made in the dilution plates and thick plate dimensions have to be used. This has resulted in further increases in costs. In many cases cleaning at state-of-the-art dilution headboxes is implemented in such a way that they are equipped with an opening structure, which can be opened owing to hinging means for the time of washing. However, the solution is expensive.

SUMMARY OF THE INVENTION

The present application presents an apparatus of a new type in the web formation for mixing dilution water and the stock conducted from the inlet header of a paper machine. According to the invention, the apparatus comprises such a body, into which inlet channels for the dilution water are drawn, which are made to open into mixing chambers for the stock and dilution water, which chambers may also be called dilution water chambers in the present application. The dilution water is conducted into the top part of each mixing chamber, so that the facing end of the dilution water will open into the mixing chamber from its top wall. In the solution according to the invention, each mixing chamber comprises at least two, preferably more rows of pipes located side by side. In bringing the dilution water into the mixing chamber it is made to flow around the pipes entering the mixing chamber and further through the flow gap between the pipe ends and the outlet pipe ends to join the stock flow and further as a joined flow of dilution water and stock $L_1+L_2$ away from the mixing chamber. In the operating situation, the mixing chamber proper is entirely filled and pressurized by dilution water.

In the new solution there is no need to exchange the tube bank and it is also suitable for headboxes provided with a fixed tube bank. The dilution can be divided simultaneously into several pipes located side by side and on top of each other using the same valve, whereby the number of valves and the costs are reduced. It has been possible to shorten the time of standstill for installation, because the tube bank need not be exchanged. The structure is a light sleeve structure and the parts can be made without any manual grinding.

In the solution according to the invention, washing of the mixing chamber can be carried out in the following manner. A duct opens into each washing chamber from the lower part of the washing chamber. The duct in question can be connected to a system of supply ducts for the washing liquid. Thus, by supplying the washing liquid from below upwards into the mixing chamber, washing liquid is made to flow in a direction opposite to the dilution water and also in a direction opposite to the stock from the stock inlet header. In this way the washing operation is made even more effective.

In the apparatus solution, the device may comprise a closing spindle, in which holes are made by boring at mixing chamber spacing. Using the spindle, the system of washing ducts can be opened and closed by a rotating or linear motion of the spindle. The closing spindle may have a circular or rectangular cross-sectional shape. The closing spindle may extend over the entire width of the headbox or it may be, so to speak, modulated in the CD direction, whereby the closing spindle extends into the area of certain mixing chambers and several closing spindles are used side by side. In the structure, the closing spindle may be placed in a groove made as a part of the body plate of the apparatus structure.

The concerned system of washing ducts allows washing the mixing chambers the lower way and individually, for example, using a pressure washer, or alternatively all mixing chambers may be connected to the same system of washing dusts, whereby supply of the washing water takes place simultaneously into all mixing chambers. Since in the washing situation the direction of flow inside the mixing chamber is changing from normal to the opposite due to the washing pipe fitting located in the lower part, cleaning of the areas soiled in the running situation becomes more effective.

The apparatus according to the invention in connection with the headbox of a paper machine or equivalent is characterized by the features presented in the claims.

The invention is presented in the following with reference to some advantageous embodiments shown in the figures of the accompanying drawings. However, the invention is not limited to these only.

DESCRIPTION OF THE PREFERRED EMBODIMENTS

Figure 1A:
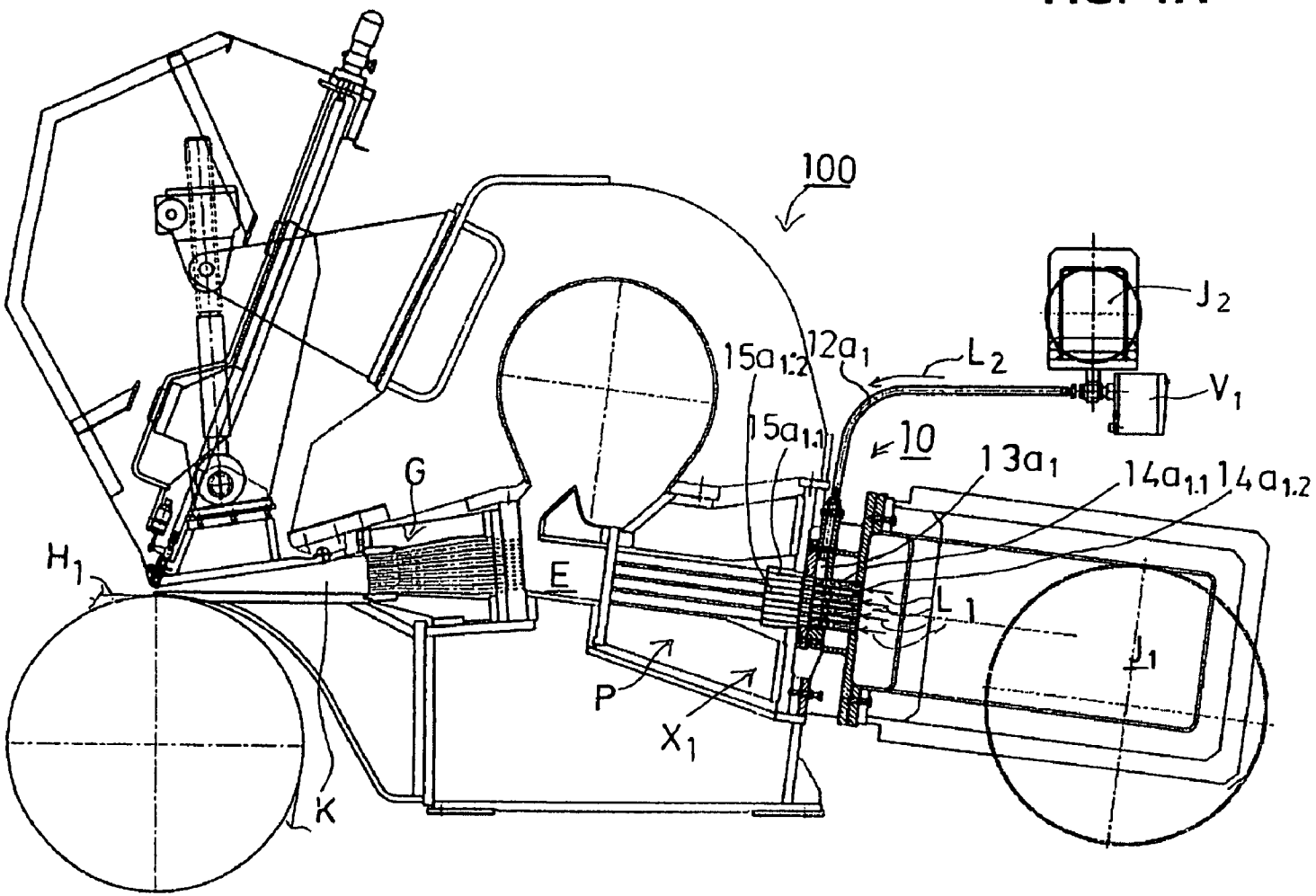
FIG. 1A is a side view and longitudinal cross-section of the headbox in a paper machine.
Figure 1B:
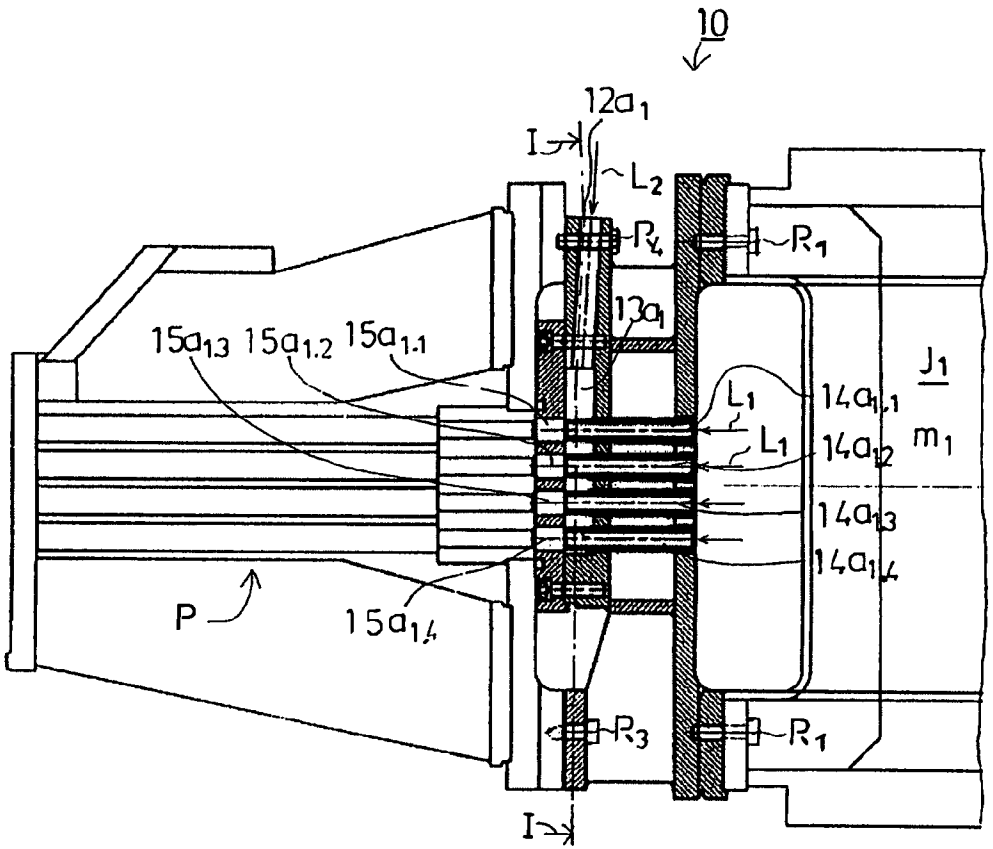
FIG. 1B shows the target area of the invention, an arrangement for supplying dilution water to join stock conducted from a stock inlet header. The figure shows target area $X_1$ from FIG. 1A.
Figure 1C:
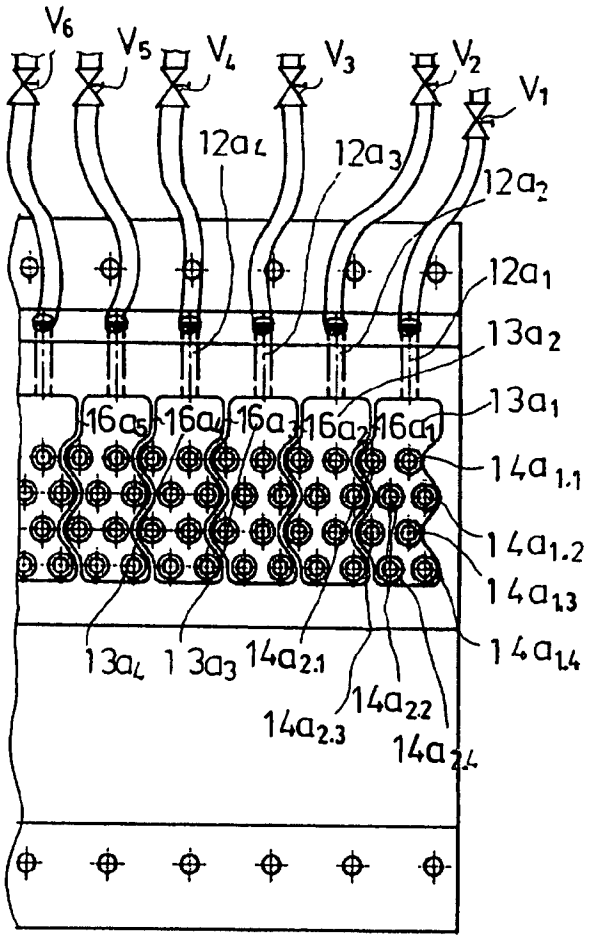
FIG. 1C is a sectional side view taken along the section line I-I in FIG. 1B.

FIG. 1A shows the so-called dilution headbox 100 of a paper machine. FIG. 1B shows the area $X_1$ of FIG. 1A on an enlarged scale. FIG. 1C shows the apparatus as a partial view from the front and as a sectional view along the line I-I of FIG. 1B.

The dilution headbox 100 comprises a stock inlet header $J_1$, shown in FIG. 1B, from which stock $m_1$ is conducted as shown by arrow $L_1$, into mixing chambers $\mathbf{13}a_1$, $\mathbf{13}a_2$ . . . of an apparatus 10 according to the invention, which chambers may also be called dilution water chambers in this application. As shown in FIG. 1A, the dilution water is conducted from a dilution water inlet header $J_2$ through ducts 12$a_1$, 12$a_2$ . . . and valves $V_1$, $V_2$ . . . regulating the flow $L_2$ into mixing chambers 13$a_1$, 13$a_2$ . . . . The ducts 14$a_{1.1}$, ducts 14$a_{1.2}$ lead from the stock inlet header $J_1$, into the mixing chambers 13$a_1$, 13$a_2$ . . . . From the mixing chambers 13$a_1$, 13$a_2$ . . . there are ducts 15$a_{1.1}$, 15$a_{1.2}$ . . . , 15$a_{2.1}$, 15$a_{2.2}$ . . . for the dilution water and stock mixture $L_1$+$L_2$ to be conducted away.

The ducts 12$a_1$, 12$a_2$ . . . lead to the mixing chambers 13$a_1$, 13$a_2$ . . . located in various width positions of the paper machine's headbox. The dilution water is used to control the consistency of the stock $m_1$ and thus the web's basis weight across the width of the web to be the desired ones by adjusting the valves $V_1$, $V_2$ . . . . Thus, the dilution valves $V_1$, are used to control the dilution water flow $L_2$ to the desired places across the headbox width and thus to control the basis weight of the paper web or equivalent across the width of the web. The dilution water flow $L_2$ arrives in each mixing chamber 13$a_1$, 13$a_2$ . . . at the desired place across the width in the desired quantity and the dilution water is mixed with the stock flow $L_1$ conducted from the inlet header $J_1$ at the concerned place over the width into the mixing chamber 13$a_1$, 13$a_2$ . . . . The combined flow $L_1$+$L_2$ is conducted further as shown in FIG. 1A into a tube bank P and further into an intermediate chamber E and further into a turbulence generator G and further through a slice cone K on to a forming wire $H_1$.

Figure 2:
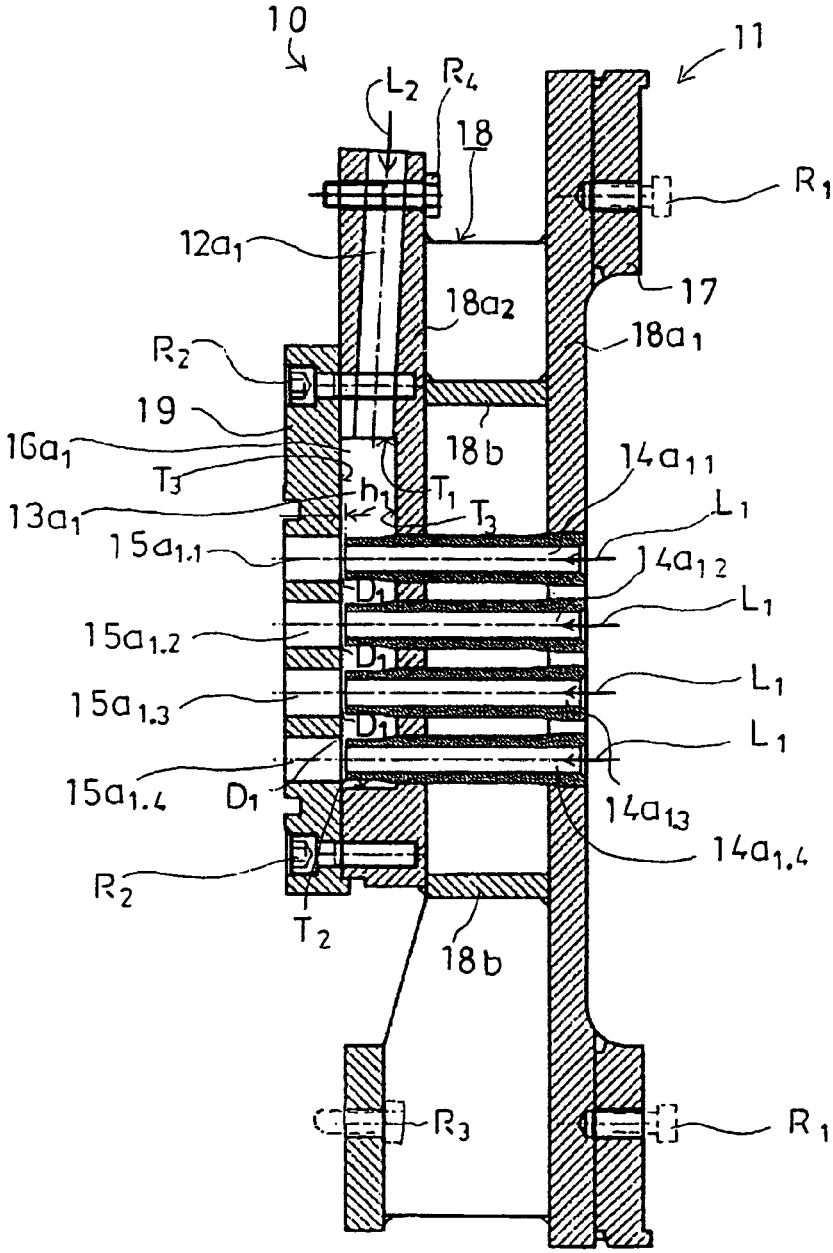
FIG. 2 shows, on an enlarged scale, a mixing chamber and the structures associated with it.

FIG. 2 shows a mixing chamber 13$a_1$ and the relating structures on an enlarged scale. The view is a longitudinal sectional view in the machine direction. As is shown in FIG. 2, the apparatus 10 comprises the following structural parts for mixing a flow of dilution liquid, preferably dilution water (arrow $L_2$), and stock $m_1$ conducted (arrow $L_1$) from the stock inlet header $J_1$ of the headbox. The apparatus 10 according to the invention for mixing dilution water and stock $m_1$ comprises a body part 11, which is connected in a module-like manner. It can be connected in between the stock inlet header $J_1$ and the tube bank P, for example, into old headboxes.

From an inlet header $J_2$ for the dilution water the dilution water is conducted into ducts 12$a_1$, 12$a_2$, 12$a_3$ . . . , each of which comprises a valve $V_1$, $V_2$ . . . . The valves $V_1$, $V_2$ . . . are used to control the flow of dilution water; the rate of flow through the ducts 12$a_1$, 12$a_2$ . . . preferably through hoses or pipes to join the flow $L_1$ of stock $m_1$ conducted from the stock inlet header $J_1$. The ducts 12$a_1$, 12$a_2$ . . . for the dilution water are drawn to the various headbox width positions, and by controlling the inlet of dilution water joining the flow $L_1$ of stock $m_1$ the dilution is controlled and thus also the consistency of the stock at each place across the width of the headbox and thus the basis weight of the web, such as a paper web, at each position over the web width.

According to the invention, the dilution water ducts 12$a_1$, 12$a_2$ . . . open into the mixing chambers 13$a_1$, 13$a_2$, 13$a_3$ . . . for stock $m_1$ and dilution water. The ducts 12$a_1$, 12$a_2$ . . . open into the top part of the mixing chambers 13$a_1$, 13$a_2$ . . . . They do not extend into the mixing chambers 13$a_1$, 13$a_2$ . . . proper, but open from the covering wall $T_1$ of the mixing chambers 13$a_1$, 13$a_2$ . . . directly into the mixing chamber 13$a_1$, 13$a_2$ . . . .

Each mixing chamber 13$a_1$, 13$a_2$ . . . comprises pipes 14$a_{1.1}$, 14$a_{1.2}$ . . . , which are drawn to the mixing chamber from a stock inlet header $J_1$ and in such a way that into each mixing chamber extend at least two duct rows, preferably pipe rows 14$a_{1.1}$, 14$a_{1.2}$ . . . ; 14$a_{2.1}$, 14$a_{2.2}$ . . . . The ducts, preferably pipes 14$a_{1.1}$, 14$a_{1.2}$ . . . ; 14$a_{2.1}$, 14$a_{2.2}$ . . . , are adapted to open into the mixing chamber 13$a_1$, 13$a_2$ . . . , in such a way that the ends of the pipes 14$a_{1.1}$, 14$a_{1.2}$ . . . are at a short distance $h_1$ from the outlet ducts, for example, pipes or, as in the figure, preferably plate borings 15$a_{1.1}$, 15$a_{1.2}$ . . . ; 15$a_{2.1}$, 15$a_{2.2}$ . . . , which outlet ducts open into the mixing chamber 13$a_1$, 13$a_2$ . . . and face the ends of the pipes. Under these circumstances, an annular gap $D_1$ is left between the ducts 14$a_{1.1}$, 14$a_{1.2}$ . . . for the stock flow and the ducts 15$a_{1.1}$, 15$a_{1.2}$ on the outlet side for the stock $m_1$ and the dilution liquid conducted thereto. The width $h_1$ of the annular gap $D_1$ is within a range of 2-8 mm, preferably 3-5 mm. Thus, the dilution water flow and the stock flow are mixed together in the space between the end of ducts 14$a_{1.1}$, 14$a_{1.2}$ . . . and the ends of the ducts 15$a_{1.1}$, 15$a_{1.2}$ on the outlet side. Thus, the term mixing chamber is used. Outside the mixing point proper the mixing chamber is filled by dilution water. The pressure of the dilution water exceeds the pressure existing in the stock flow, whereby the direction of flow of the dilution water is from the mixing chamber 13$a_1$, 13$a_2$ . . . into the ducts 15$a_{1.1}$, 15$a_{1.2}$.

Under these circumstances, the dilution water is conducted from the ducts, such as pipes 12$a_{1.1}$, 12$a_2$ . . . , into the mixing chambers 13$a_1$, 13$a_2$ . . . located side by side, which in the present application may also be called dilution water chambers, and it will flow into each mixing chamber 13$a_1$, 13$a_2$ . . . from above downwards and around the ducts 14$a_{1.1}$, 14$a_{1.2}$ . . . on the inlet side of the mixing chamber 13$a_1$, 13$a_2$ . . . for the stock $m_1$, and further through the annular gaps $D_1$ into each duct 15$a_{1.1}$, 15$a_{1.2}$ . . . ; 15$a_{2.1}$, 15$a_{2.2}$ . . . on the outlet side of the mixing chamber 13$a_1$, 13$a_2$ . . . as a flow $L_2$+$L_1$. The dilution water fills the mixing chambers 13$a_1$, 13$a_2$ . . . , and the actual mixing together of the dilution water and the stock $m_1$ takes place in the space between the ducts 14$a_{1.1}$, 14$a_{1.2}$ . . . on the inlet side and the ducts 15$a_{1.1}$, 15$a_{1.2}$ . . . on the outlet side.

Thus, each mixing chamber 13$a_1$, 13$a_2$ . . . is a free space, which is limited only by the mixing chamber's covering wall $T_1$ and bottom wall $T_2$ and vertical walls $T_3$ and by the partition walls 16$a_1$, 16$a_2$ . . . separating the mixing chambers 13$a_1$, 13$a_2$ . . . . Into the concerned free internal space of the mixing chamber 13$a_1$, 13$a_2$ . . . extend the ducts for the stock $m_1$ drawn from the stock $m_1$ inlet header $J_1$, such as pipes 14$a_{1.1}$, 14$a_{1.2}$ . . . , and in such a way that there are inlet ducts into each mixing chamber 13$a_1$, 13$a_{1.2}$ . . . in at least two adjacent rows, preferably in three or even in more rows. The ducts, such as pipes 14$a_{1.1}$, 14$a_{1.2}$ . . . , in each row, and correspondingly the outlet ducts 15$a_{1.1}$, 15$a_{1.2}$ . . . , may be in non-linear rows superimposed in a zigzag fashion.

The body 11 of the device according to the invention with its parts mentioned above can easily be connected in between the stock inlet header $J_1$ and the tube bank P of old headboxes, and thus the old headbox structure is easily changed afterwards and made into a dilution headbox. According to the invention, the partition walls 16$a_1$, 16$a_2$ . . . may be designed as curved structures and, in addition, according to the invention, adjacent duct rows or pipe rows may be staggered in relation to each other in a zigzag-like manner, whereby marking of the web is avoided.

The device body 11 comprises a first facing plate 17. The facing plate 17 is joined by screws $R_1$ to the basic body 18, to its plate 18$a_1$. Another facing plate 19 is further joined to a plate 18$a_2$ by screws $R_2$. The plates 18$a_1$, and 18$a_2$ are connected by ribs 18$b$. The apparatus 10 is connected by screws $R_1$, $R_3$ and $R_4$ to the tube bank P and to the stock inlet header $J_1$, and, for example, to an old headbox.

Figure 3:
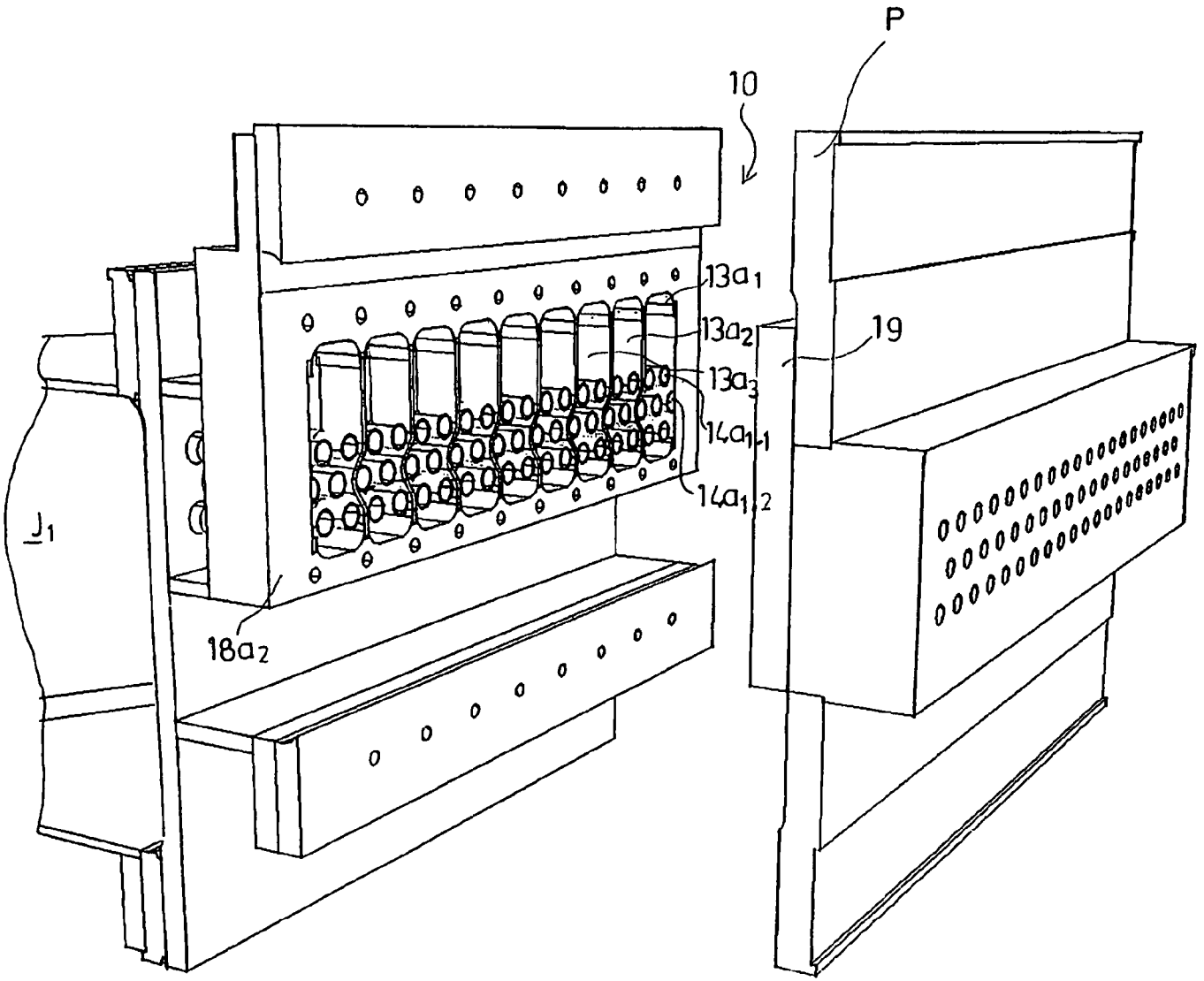
FIG. 3 is an axonometric view of the formation of a mixing chamber structure.

FIG. 3 is an illustrating axonometric view of the apparatus 10 according to the invention separately front the tube bank P before it is joined to the tube bank P. The embodiment is otherwise like the structure shown in the other figures, but each vertical row comprises only three ducts 14$a_{1.1}$, 14$a_{1.2}$, 14$a_{1.3}$ . . . 15$a_{1.1}$, 15$a_{1.2}$, 15$a_{1.3}$; 14$a_{2.1}$, 14$a_{2.2}$, 14$a_{2.3}$ . . . 15$a_{2.1}$, 15$a_{2.2}$, 15$a_{2.3}$.

Figure 4A:
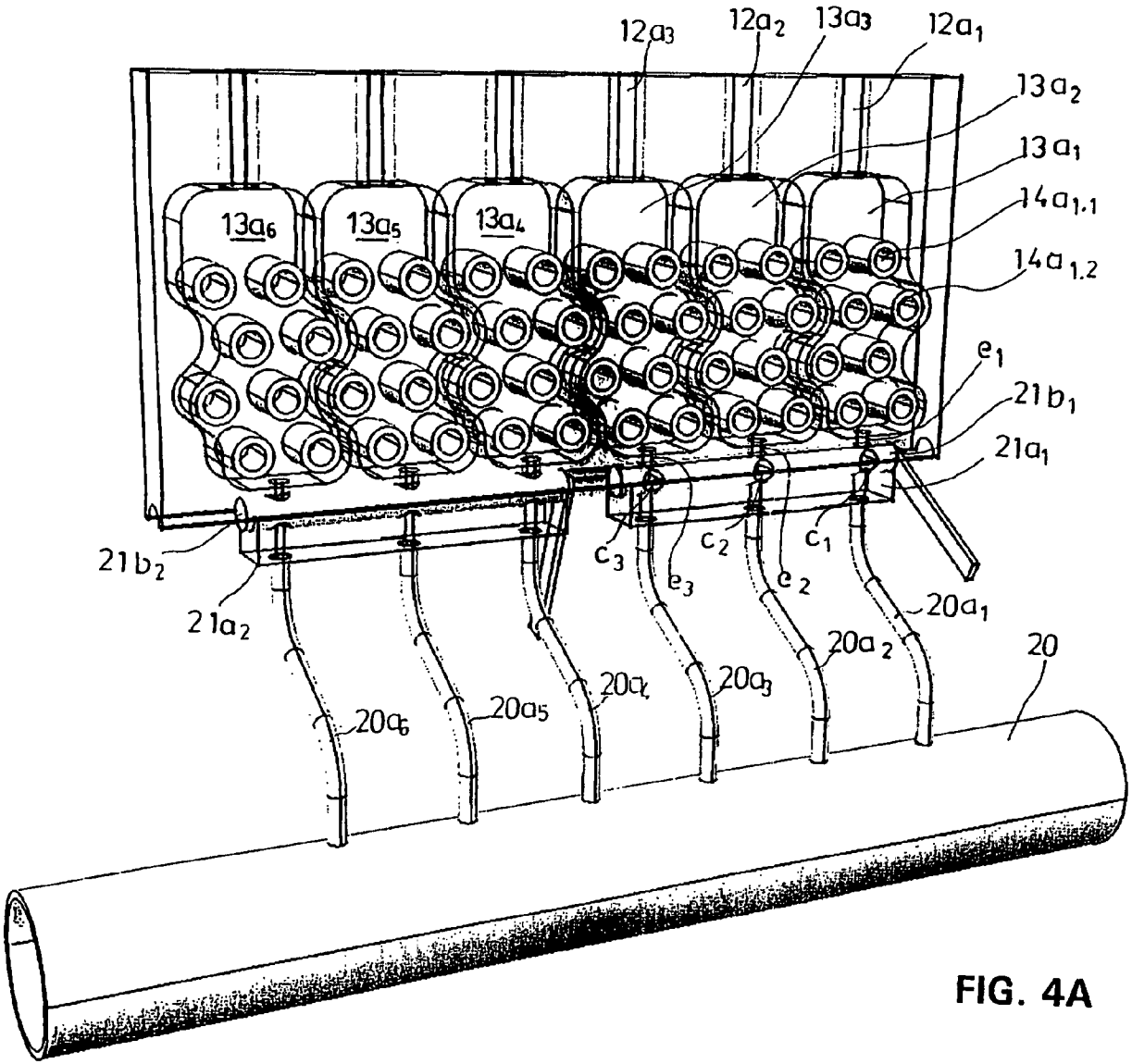
FIG. 4A is an example in principle of an arrangement for washing mixing chambers.
Figure 4B:
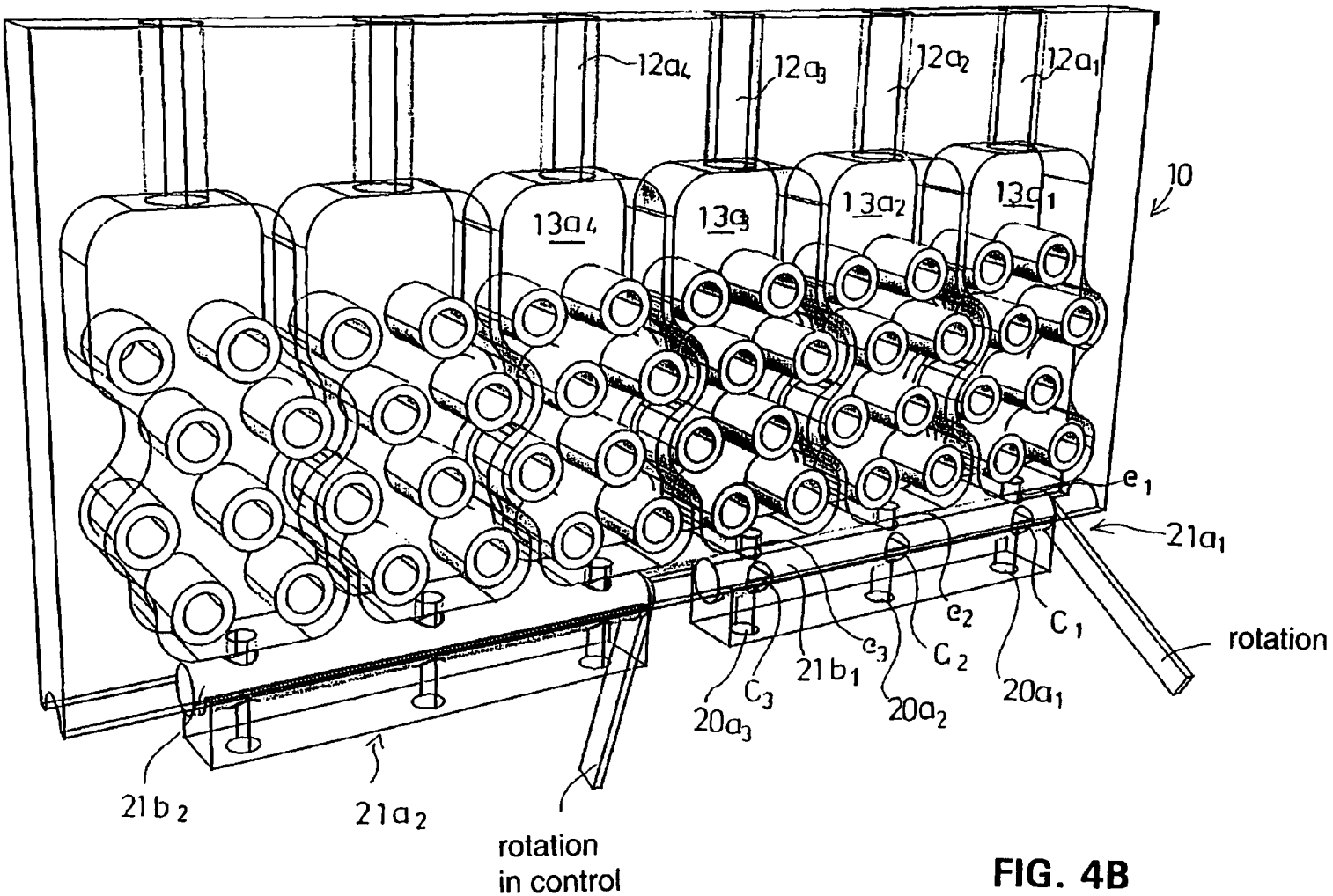
FIG. 4B shows washing modules on an enlarged scale.

FIGS. 4A and 4B show washing of the mixing chambers 13$a_1$, 13$a_2$ . . . and ducts 14$a_{1.1}$, 14$a_{1.2}$ . . . , 15$a_{1.1}$, 15$a_{1.2}$. Washing of the mixing chamber 13$a_1$, 13$a_2$ . . . may be performed efficiently by joining the inlet duct 20 for washing liquid to each washing liquid duct 21$a_1$, 21$a_2$ . . . opening into each mixing chamber 13$a_1$, 13$a_2$ . . . . Thus, washing of the mixing chamber 13$a_1$, 13$a_2$ . . . can be performed by making the washing liquid flow from below upwards from the bottom part of the mixing chamber 13$a_1$, 13$a_2$ . . . to its top part and out through the inlet ducts 12$a_1$, 12$a_2$ . . . for dilution water and the ducts 14$a_{1.1}$, 14$a_{1.2}$ . . . , 15$a_{1.1}$, 15$a_{1.2}$. For efficiently washing, washing should be done in the direction opposite to the direction of flow during operation.

The inlet duct 20 for washing liquid is connected to each mixing chamber 13$a_1$, 13$a_2$ . . . . As is shown in FIG. 4A, the washing duct 20 is branched into branch ducts 20$a_1$, 20$a_2$, 20$a_3$, which join a washing module 21$a_1$. Correspondingly, branch ducts 20$a_4$, 20$a_5$, 20$a_6$ join another washing module 21$a_2$. The washing module 21$a_1$ has an adjusting or closing spindle 21$b_1$ and the washing module 21$a_2$ has an adjusting or closing spindle 21$b_2$. In the embodiment shown in the figure, the adjusting spindle is turned to align the perforations $C_1$, $C_2$ . . . of the adjusting spindle with the ducts 20$a_1$, 20$a_2$, 20$a_3$ . . . and with ducts $e_1$, $e_2$ . . . opening into the mixing chambers 13$a_1$, 13$a_2$ . . . , and in this way a connection can be opened to each mixing chamber 13$a_1$, 13$a_2$ . . . .

A paper machine or equivalent means paper, board and tissue machines as well as pulp drying machines.

The invention claimed is:

1. A headbox dilution apparatus, comprising;

a device body, having a first plate, a second plate, and a tube bank;

a first facing plate mounted to the device body arranged to match the device body to an inlet header of a headbox;

wherein the first plate mounts to the first facing plate, the first plate having a stock inlet header facing surface;

wherein the second plate is connected to the first plate in spaced parallel relation by a plurality of ribs;

a second facing plate having a tube bank facing surface, the second facing plate connected to the second plate to define a plurality of mixing chambers therebetween;

the plurality of mixing chambers located side by side in a cross machine direction, and each mixing chamber of the plurality of mixing chambers being limited by a covering wall (T1), a bottom wall (T2), an inlet side wall (T3) and partition walls (16*a*) which separate the mixing chambers all formed by portions of the second plate; and further by an outlet side wall (T3) formed by the second facing plate;

wherein the tube bank is formed of a plurality of inlet ducts extending from the stock inlet header facing surface of the first plate through the second plate, the inlet ducts arranged in adjacent vertical rows, the vertical rows arrayed in the cross-machine direction, wherein there are at least two vertical rows arranged through which stock can flow to each mixing chamber, the inlet ducts extending into the mixing chambers a selected distance;

wherein the second facing plate forms a plurality of outlet ducts, one outlet duct for each inlet duct of the plurality of inlet ducts, each outlet duct aligned with said each inlet duct, the outlet ducts starting on the outlet side wall formed by the second facing plate, and extending through the second facing plate to the tube bank facing surface of the second facing plate, whereby an annular gap is left between each inlet duct and each outlet duct, so that when a communicating mixing chamber of said plurality of mixing chambers is filled by dilution water the dilution water is conducted through the annular gap to join stock flowing through the outlet ducts;

a single valve connected to each mixing chamber arranged to control a dilution flow; and wherein the headbox dilution apparatus is arranged to be connected between a stock inlet header and a tube bank of an existing headbox.

2. The apparatus of claim 1, wherein the width of the annular gaps is within a range of 2-8 mm.

3. The apparatus of claim 1, wherein the width of the annular gaps is within a range of 3-5 mm.

4. The apparatus of claim 1, wherein the first facing plate is connected to the inlet header of the headbox by screws, and the second facing plate is connected by screws to a tube bank.

5. The apparatus of claim 1, wherein the first facing plate of the body is connected to a stock inlet header and the second facing plate is connected to a tube bank of a headbox.

6. The apparatus of claim 1, wherein the bottom wall of each mixing chamber is connected to a header washing duct in such a way that the plurality of mixing chambers can be washed from below upwards.

7. The apparatus of claim 6, wherein the header washing duct further comprises branch ducts, which branch ducts join a washing module, and wherein the washing module has an adjusting spindle with flow openings therein, and wherein the adjusting spindle abuts the second plate so that the flow openings of the adjusting spindle are aligned with the branch ducts and with washing ducts leading into the mixing chambers, and wherein the adjusting spindle is positionable to prevent flow of washing liquid into the mixing chamber.

8. The apparatus of claim 1 wherein the mixing chambers partition walls form curved structures so that the mixing chambers overlap in a crossmachine direction and wherein the plurality of inlet ducts are staggered in relation to each other in a zigzag-like manner, so that the ducts of one mixing chamber overlie ducts of an adjacent mixing chamber.

* * * * *